US010271622B2

(12) United States Patent
Fleming

(10) Patent No.: US 10,271,622 B2
(45) Date of Patent: Apr. 30, 2019

(54) PORTABLE SUNSHADE

(71) Applicant: Ryan C. Fleming, Orange, CA (US)

(72) Inventor: Ryan C. Fleming, Orange, CA (US)

( * ) Notice: Subject to any disclaimer, the term of this patent is extended or adjusted under 35 U.S.C. 154(b) by 0 days.

(21) Appl. No.: 16/049,467

(22) Filed: Jul. 30, 2018

(65) Prior Publication Data

US 2019/0029377 A1 Jan. 31, 2019

Related U.S. Application Data

(60) Provisional application No. 62/538,996, filed on Jul. 31, 2017.

(51) Int. Cl.
*A45B 23/00* (2006.01)
*A45B 11/00* (2006.01)

(52) U.S. Cl.
CPC ..... *A45B 23/00* (2013.01); *A45B 11/00* (2013.01); *A45B 2023/0093* (2013.01)

(58) Field of Classification Search
CPC . A45B 11/00; A45B 23/00; A45B 2023/0093; A47C 7/66
See application file for complete search history.

(56) References Cited

U.S. PATENT DOCUMENTS 960,849 A * 6/1910 Dilg ..... E04H 15/322 135/119
4,865,380 A * 9/1989 Heitzman-Powell .... A47C 7/66 297/184.13
5,033,528 A 7/1991 Volcani
5,397,268 A * 3/1995 Chang ..... A45B 3/00 297/184.1
D554,850 S 11/2007 Acosta
8,006,947 B1 * 8/2011 Londo ..... A47G 7/044 248/217.1
D809,282 S 2/2018 Pucci
9,970,212 B2 * 5/2018 Summers ..... E04H 15/34
2009/0139669 A1 6/2009 Robin
2011/0048482 A1 * 3/2011 Yerian ..... E06B 9/24 135/125
2012/0097347 A1 * 4/2012 Sweeney ..... A45B 11/00 160/351
2017/0009482 A1 1/2017 Remolina

FOREIGN PATENT DOCUMENTS

DE 102011120999 A1 * 6/2013 ..... A45B 19/00

* cited by examiner

*Primary Examiner* — Noah Chandler Hawk
(74) *Attorney, Agent, or Firm* — Knobbe Martens Olson & Bear LLP

(57) ABSTRACT

A portable sunshade or sunshade kit can include an expandable screen, a support rod, a connection spool, and/or a carry case. The expandable screen can have an outer wire loop that tensions a screen material and allows the screen to be folded into a collapsed configuration. The support rod can have a ductile core and a rubberized coating around the ductile core that grips a support object such as a chair or railing. A connection spool attached to the screen material can include a channel sized to at least partially receive the support rod. The connection spool can be adhered to the screen material. The carry case can be sized to receive the expandable screen in the collapsed configuration, the support rod, and the connection spool for ease of transport.

20 Claims, 10 Drawing Sheets

PORTABLE SUNSHADE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Shade structures devices, such as sunshades and umbrellas, are used to protect people from the elements such as the sun and/or rain. Shade structures can be used in various contexts including at the beach, during recreational areas, poolside, backyards, outdoor seating and generally provide shade to a persons engaged in outdoor activities.

BRIEF DESCRIPTION OF THE DRAWINGS

The features disclosed herein are described below with reference to the drawings. The drawings are provided to illustrate embodiments of the inventions described herein and not to limit the scope thereof.

DETAILED DESCRIPTION OF EXAMPLE EMBODIMENTS

Overview

Figure 1:
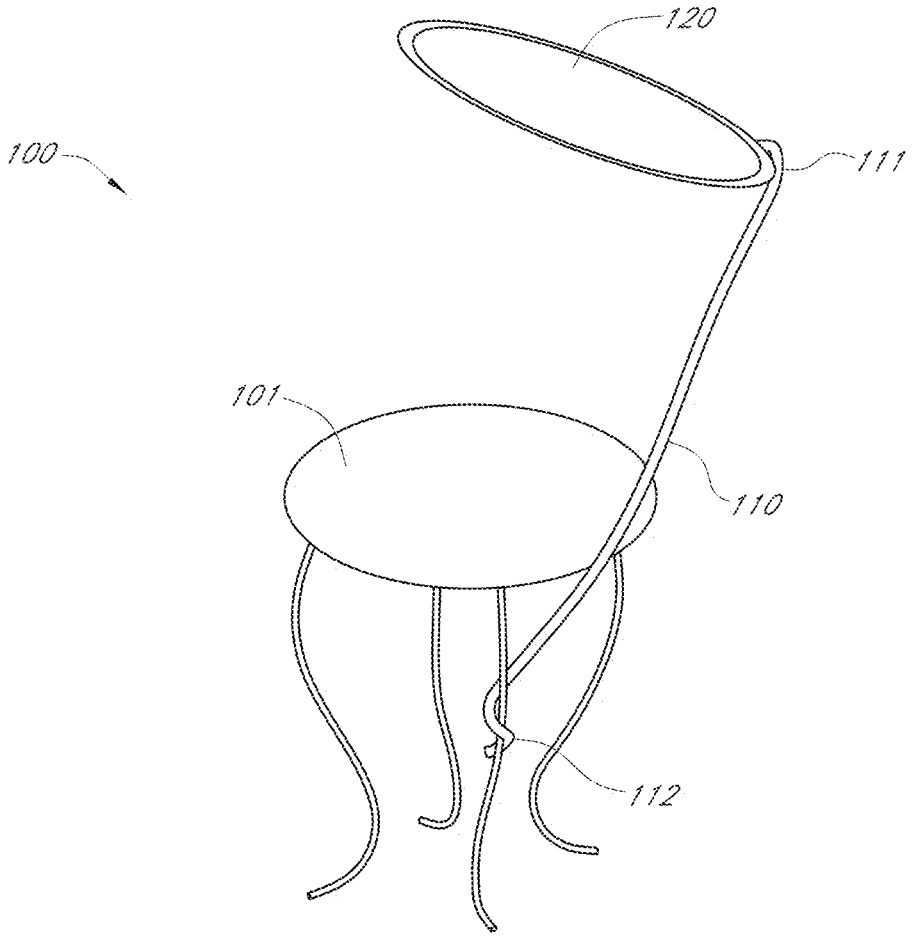
FIG. 1 is a perspective view of an example sunshade in an example usage environment attached to a support object.

Some shade structures can be cumbersome to setup, stow and carry from place to place. Large shade structure are therefore typically installed in a permanent or semi-permanent manner. Smaller sunshades can be made portable and therefore more convenient and easy to transport. In addition, smaller sunshades can be made to be configurable to allow a user to adjust the position of the shade structure based on the position of the sun and/or the position of the object intended to be shaded. Embodiments of present disclosure are directed to various improvements of portable sunshades.

One example aspect of the present disclosure is the recognition of various disadvantages and limitations of existing portable sunshades. For example, conventional sunshades often include a clamp or clip structure to attach the shade device to a support object such as a chair, table, railing or other object. Clamps typically include a pair of spring-loaded jaws that open on a pivot. This structure limits the available objects that the clamp can attach to because the jaws only open to a certain width, depending on the geometry of the jaws. Also, the clamping strength of the jaws can also be insufficient to support the sunshade when gripping relatively thin materials. Moreover, clamps add unnecessary cost and complexity to a sunshade. Costs associated with manufacturing a clamp, as well as a connection mechanism to the portable sunshade, can be relatively high in relation to the overall cost of a small portable sunshade. The clamp (for example, the jaws, pivot or torsion spring) is also a common failure point of sunshades. Once the clamp is broken, the portable sunshade is often unusable.

Another limitation of existing sunshades is the connection between the screen and its support member. Typically, the connection includes one of various types of mechanical couplings, such as screws, clamps, clips, pins, and other similar. Each of these mechanical couplings adds cost and complexity both in materials and assembly time. The mechanical coupling can also add unnecessary bulk or protrude in a manner than inhibits the compactness and portability of the sunshade. Moreover, failure of the mechanical coupling is common.

This disclosure describes various example devices, systems, and methods that can address and/or improve upon at least some of the above-mentioned problems, or others.

For example, a portable sunshade can include an expandable screen for providing shade, a flexible support rod for providing support to the expandable screen, and a connection spool for attaching a first end of the support rod with the expandable screen. A second end of the support rod can attach directly to a support object.

One advantage of the flexible support rod in certain embodiments is that the second end of the support rod may not include a clamp. Instead, the second end of the support rod can frictionally engage a support object having any of a wide variety of dimensions and profiles to provide a stable location for fixing the portable sunshade. A rubberized outer surface of the support rod can provide engagement with the support object. The support rod can be ductile such that it can be wrapped at least partially around a portion of the support object.

The connection spool can include a channel, and the first end of the support rod can be engaged within the channel to attach with the expandable screen. The connection spool can be adhered to the expandable screen.

The portable sunshade can also be a part of a kit. The kit can include a case for storing the expandable screen, connection spool and support rod. The expandable screen can have a collapsed configuration for storage within the case. In the collapsed configuration, the expandable screen can be approximately the same size as the connection spool. The kit can also include a second spool. The second spool can include an adhesive for attaching to the support object. The second spool can be adhered to the support object where the support object does not provide any attachment point for the second end of the support rod.

Example Sunshades

As shown in FIG. 1, an example portable sunshade 100 can include an expandable screen 120 and a support rod 110. A first end 111 of the support rod 110 can be attached to the expandable screen 120. A second end 112 of the support rod 110 can be attached to a support object 101. The sunshade 100 can be designed for providing shade to a person or an object in a variety of contexts. However, in some embodiments, the sunshade 100 is sized to provide shade to an object, such as a cold drink or food item (such as an ice cream or similar confection), rather than a person. Thus, the support object 101 can vary in size according to the environment of use.

As illustrated, the support object 101 is a table with the support rod 110 wrapped around one leg. Different support structures can also be used. Specifically, the support object 101 can be any object about which the support rod 110 can be attached (for example, by wrapping around). For example, the support object 101 can be a table, a leg of a table, or chair, an armrest, a railing or other object.

The support rod 110 can be configurable and can support the expandable shade 120. For example, the support rod 110 can include a ductile central wire core (not shown). The core of the support rod can include single or multiple wire strands. The ductile central wire can be bendable by a user to position the expandable screen 120 in a desired position. The wire can include a steel or stainless steel, copper, nickel, or some other material. The support rod 110 can also include a rubberized outer material or coating. The rubberized outer material can be a rubber, polymer, silicon or other material that is grippable or that has a high coefficient of friction. In one example, the support rod 110 is a GEAR TIE® reusable rubber twist tie sold by Nite Ize, Inc.™ Other support rods can also be used.

The ductile central wire can facilitate attachment of the first end 111 with the expandable screen 120 and the second end 112 with the support object 101. The flexible support rod 110 can allow the user to configure the position of the screen 120 as desired. The first and second ends 111, 112 can include a cap protecting the interior portions of the support rod 110.

Figure 2:
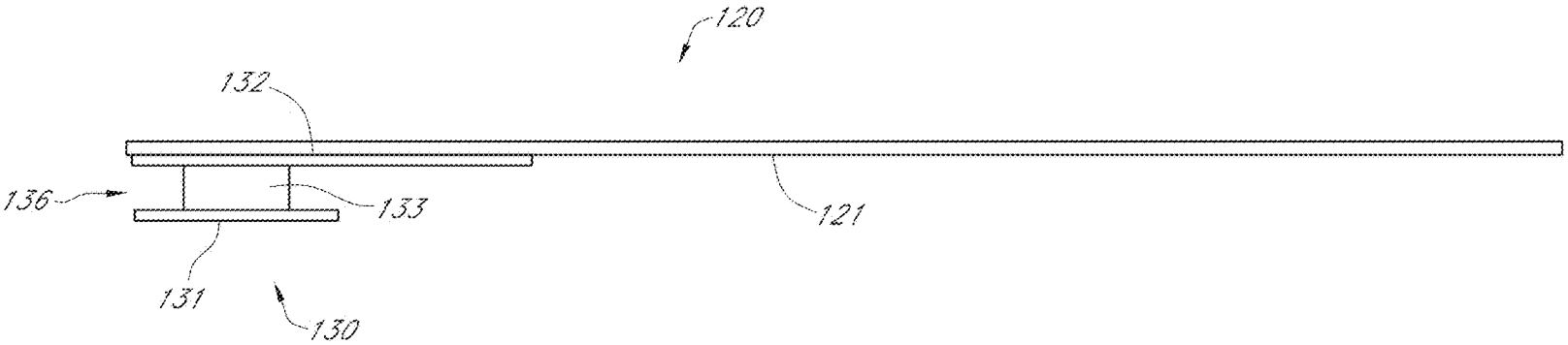
FIG. 2 is a side view of an example expandable screen.
Figure 3:
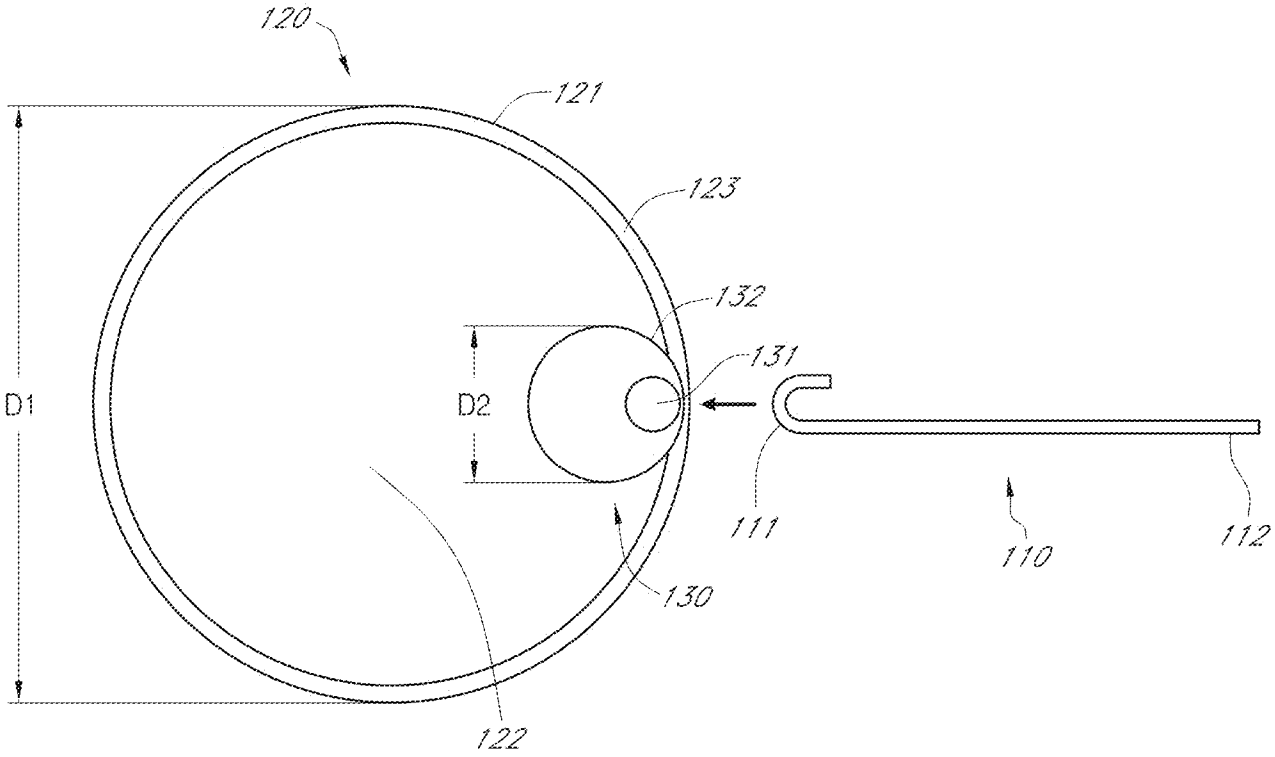
FIG. 3 is a top view of the expandable screen and an example support rod.

With reference to FIGS. 2 and 3, the screen 120 can include a screen material 122. The screen material 122 can be a woven fiber fabric, such as TYVEC® or nylon, a textile, or any other suitable material for blocking sunlight. The screen material 122 can include custom patterns, logos, or designs. Custom patterns, logos, or designs can make the overall visual appeal of the sunshade 100 more appealing. Further, custom patterns, logos, or designs can enable a business purchaser of the sunshade 100 to personalize the sunshade 100, for example, by including a logo of their business. A resort, for instance, may wish to provide free sunshades 100 to its customers, emblazoned with a logo of the resort, or perhaps with an advertisement for resort products or services.

The screen material 122 can be attached to a rim 121. The rim 121 can include a wire ribbon located within an outer pocket 123. The outer pocket 123 can be sewn, adhered, or otherwise attached to the screen material 122 with the wire ribbon disposed therein. The wire ribbon can include first and second ends that are attached to each other by a mechanical means such as welding or a clamping mechanism. The wire ribbon can be formed of a plastic, metallic, or other suitable material. The material of the pocket 123 can be formed of nylon or another suitable material. The rim 121 can function to provide a tension across the screen material 122 in an expanded configuration. In addition, the rim 121 can be flexible for permitting a folding or collapsed configuration, as discussed below.

The screen 120 can be folded into a compact configuration for storage or expanded into an expanded configuration for providing shade. The compact configuration can be achieved by folding the rim 121 over itself. The expanded configuration can be achieved from the compact configuration by allowing the rim to expand as a loop. The user can optionally deploy and stow by screen 120 by folding/unfolding the rim 121.

The screen 120 may optionally be formed to have any suitable profile in the expanded configuration (for example, circular, elliptical, semicircle square, rectangular, octagonal, other polygon, etc.). The screen 120 can include a diameter D1. In certain implementations, the diameter D1 can measure approximately: between 4 inches and 16 inches, less than 4 inches, or greater than 16 inches. In one implementations, the diameter D1 is approximately 12 inches. As used herein "approximately," in addition to having its ordinary meaning, means within 10% of a given numerical value.

The screen 120 can include a spool 130. The spool 130 can include an upper disk 132 and a lower disk 131. The outermost profiles of the upper or lower disks 132, 131, as shown in FIG. 3 can be any suitable shape. Optionally, the upper and lower disks 132, 131 are circular. In some other implementations, the shape of the upper or lower disks 132, 131 can be a decorative design (such as a star, ellipse, oval, semicircle, square, polygon or any other suitable uniform or nonuniform shape). The spool can have a diameter of D2.

A channel 136 can be formed between the lower disk 131 and the upper disk 132. A spool core 133 can offset the upper disk 132 and the lower disk 131 to create the channel 136. Optionally, the spool core 133 is circular, although this is not required. The channel 136 can be sized such that the support rod 110 can be fit at least partially within the channel 136. In one implementation, the channel 136 has a width between the upper and lower disks such that the support rod 110 can be engaged within the channel 136 by a pressure fit. For example, the channel can be slightly smaller (for example, 1-10% smaller) than the largest outside diameter of the rubberized material of the support rod, and the rubberized material can be compressed to fit within the channel 136.

Figure 4B:
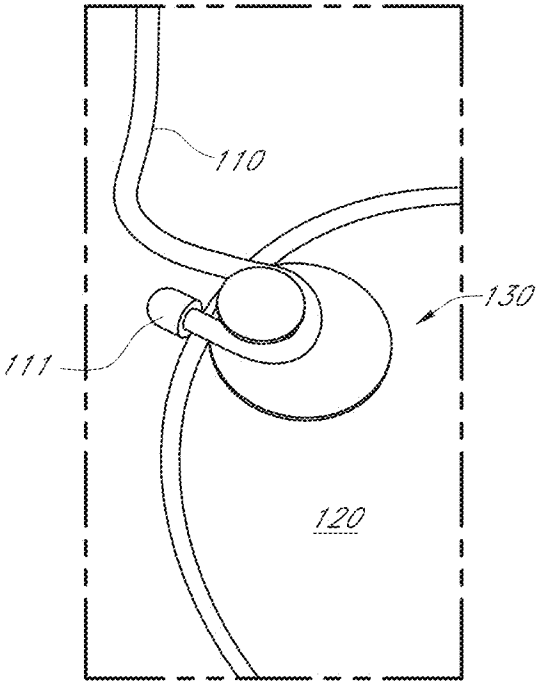
FIGS. 4A-B illustrate example attachment of the support rod with an example spool of the expandable screen.
Figure 4A:
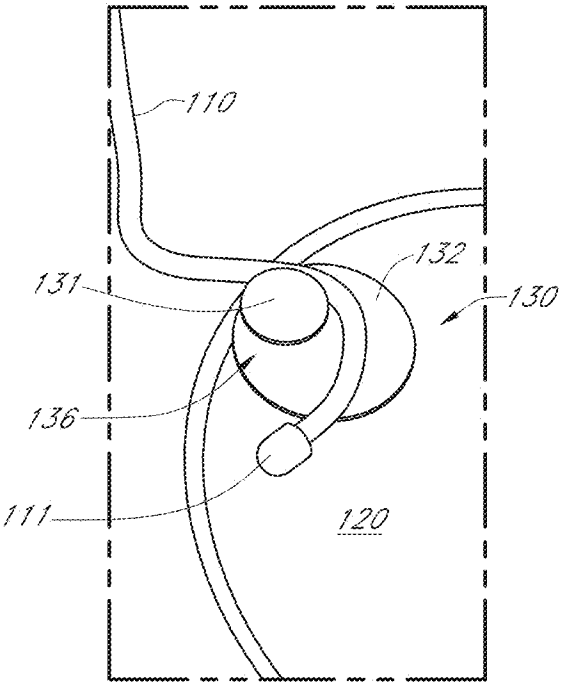

As shown in FIGS. 3-4B, the spool 130 can attach the screen 120 with the support rod 110. The upper disk 132 can attach to the screen material 122. The attachment between the upper disk 132 and the screen material 122 can be by any suitable adhesive or mechanical coupling. Optionally, the attachment can permanently affix the spool 130 with the screen 120. The first end 111 of the support rod 110 can couple within the channel 136 of the spool. The first end 11 of the support rod 110 can at least partially wrap around the spool 130 within the channel 136. For example, the first end 111 can be formed into a generally U-shaped segment that fits within the channel 136. This connection arrangement can be mechanically simple, includes relatively cheap components to manufacture, can be compact, and can have few significant failure modes, thus offering significant improvements over existing art.

The user can set up the sunshade 100 by attaching the first end 111 with the screen 120 through the spool 130 and by attaching the second end 112 directly to the support object 101. The support rod 110 (for example, either of the ends 111, 112) does not include a clamp in some embodiments. A clamp can be any jawed attachment mechanism for attaching the support rod 110 to the support object. As noted above, clamps can limit the available support objects 101 and can increase the complexity and cost of the sunshade 100. Thus, by eliminating the clamp in favor of the flexible support rod 110 in some embodiments, the sunshade 100 can improve over existing sunshade devices.

Figure 5B:
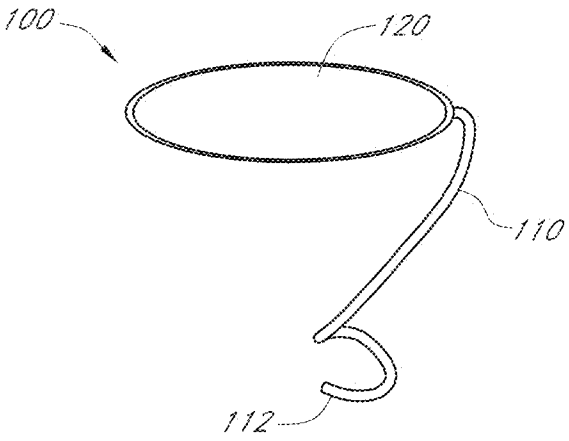
FIG. 5B illustrates the portable sunshade in an example free-standing configuration.
Figure 5A:
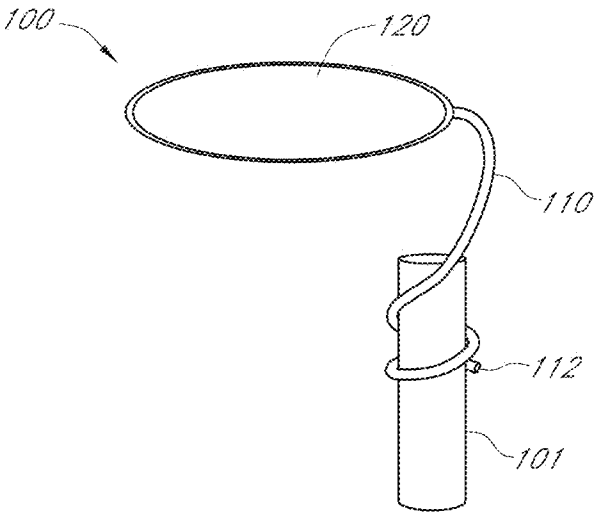
FIG. 5A illustrates the portable sunshade attached to an example vertical support object.

As illustrated in FIGS. 5A-6B, the sunshade 100 can support the sunshade 100 in a variety of positions without a clamp. With reference to FIG. 5A, the second end 112 of the support rod 110 can be attached to the support object 101 in the form of a generally vertical pole or leg by at least partial wrapping and engaging the rubberized gripping material therewith. With reference to FIG. 5B, if there is not an available attachment to the support object 101, the second end 112 can be placed in a widened or partially coiled configuration, forming its own base so that the sunshade 100 can be free-standing.

Figure 6B:
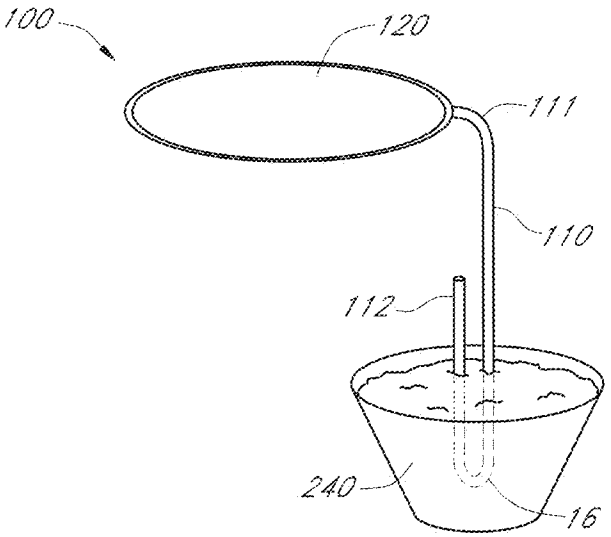
FIG. 6B illustrates the portable sunshade supported within an example medium.
Figure 6A:
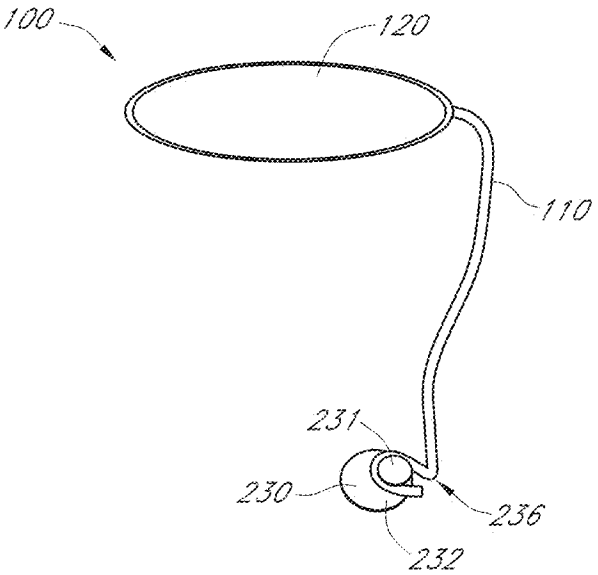
FIG. 6A illustrates the portable sunshade attached to an example second spool.

With reference to FIG. 6A, in one implementation, the sunshade 100 can include a second spool 230 for creating a semi-permanent attachment location on the support object 101. The second spool 230 can have a similar structure to the spool 130. The second spool 230 can include a channel 236. The channel 236 can be disposed between an upper disk 232 and a lower disc 231. The upper disk 232 can include an adhesive. The adhesive can be attached to a surface of the upper disk 232, and the user can attach the second spool 230 to the support object 101 using the adhesive. The second end 112 of the support rod can be engaged within the channel 236 to support the screen 120.

With reference to FIG. 6B, the support rod 110 can be formed into a stake for supporting the screen 120 within a flowable medium 240. For example, the flowable medium 240 can include ice and water or ice in an ice bucket, sand (such as a spot on the beach), or other material. The support rod 110 can be formed to include a staked point 116 that can be inserted within the flowable medium 240.

Figure 7B:
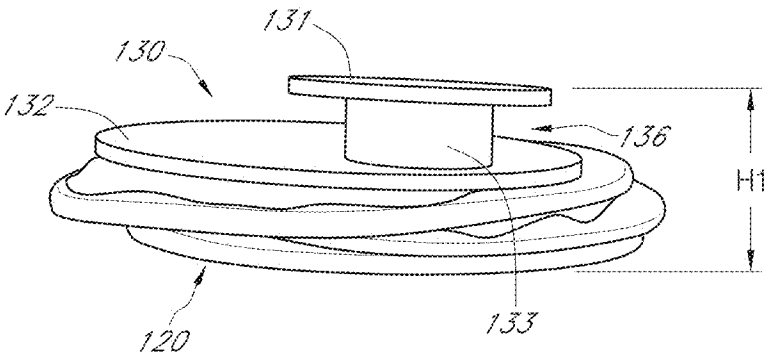
FIG. 7B illustrates a side view of the expandable screen in the example collapsed configuration.
Figure 7A:
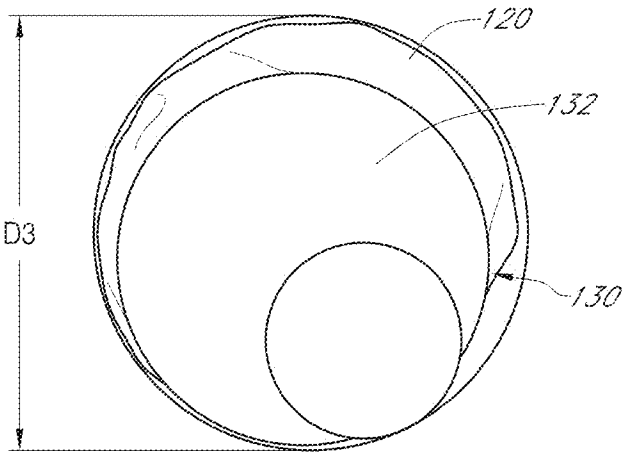
FIG. 7A illustrates a top view of the expandable screen in an example collapsed configuration.
Figure 8:
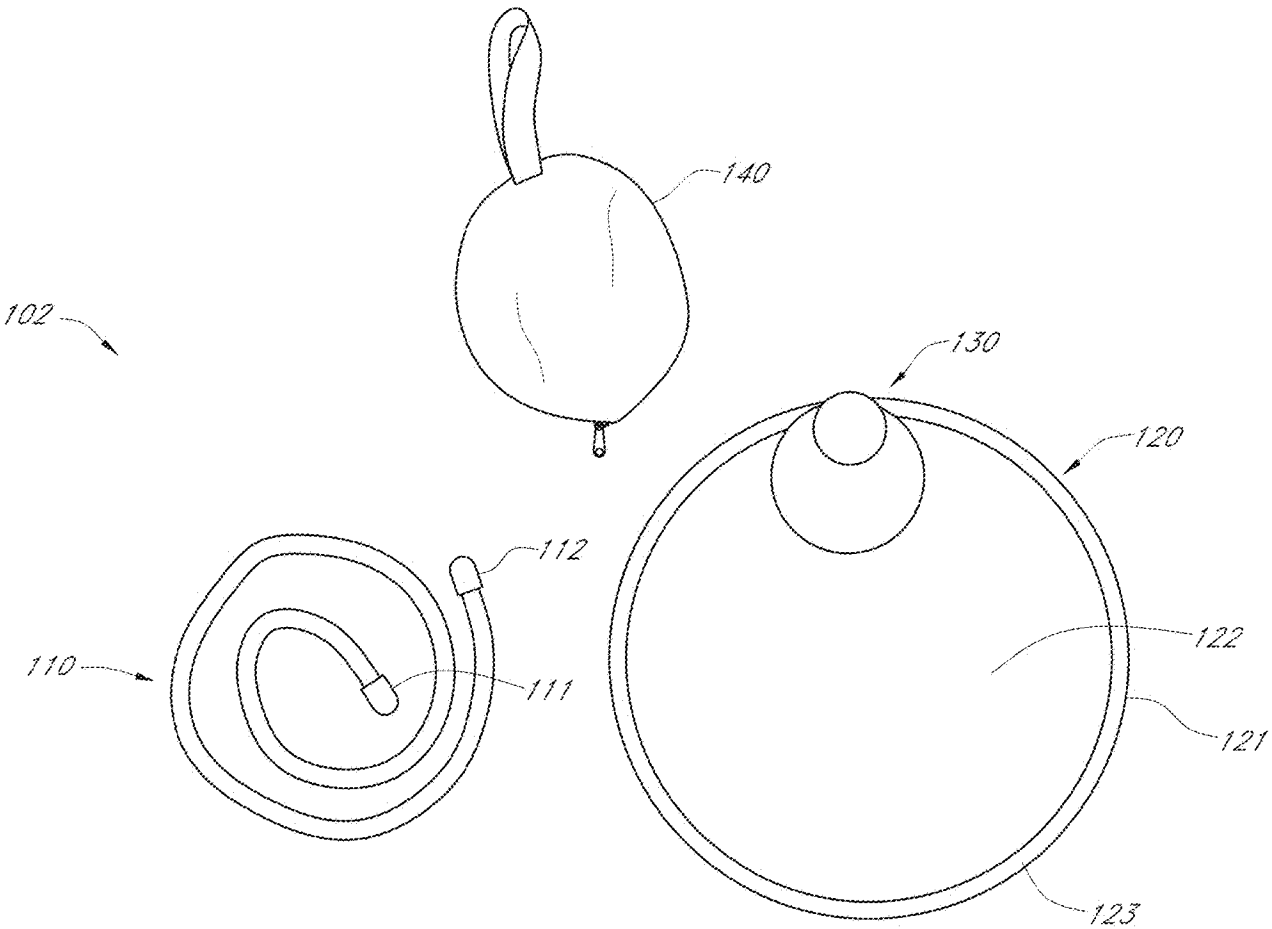
FIG. 8 illustrates an example portable sunshade kit.

FIGS. 7A-7B illustrate the example screen 120 and spool 130 in an example collapsed configuration. The screen 120 in the collapsed configuration can have approximately the same diameter as the spool 130, or the same volume, for compact storage. The collapsed configuration of the screen 120 can have a diameter D3. In certain implementations, the diameter D3 can be related to the diameter D1. For example, D3 can be approximately ⅓ or ¼ of D1. Diameter D2 can be selected to be approximately that of D3 (or slightly smaller). For example, diameter D1 can be 12 inches, diameter D3 can be 4 inches and diameter D2 can be between approximately 3 and 4 inches. Many other dimensions can be chosen.

The screen 120 in the collapsed configuration can have a height of H1. The height H1 can be approximately between 1 and 1.5 inches, less than 1 inch, or greater than 1.5 inches. This height can enable the screen 120 to be collapsed into the collapsed configuration with the spool 130 still attached, which can enable the sunshade 100 to be highly portable.

The position of the spool 130 on the screen material 122 can facilitate the user manipulating the position of the screen 120. For example, the spool can be in a location adjacent (for example, offset radially inwardly) to the outer edge of the screen 120. For example, this position can be adjacent the rim 121. The position of the spool 130 on the screen material 122 also allows the screen 120 to be collapsible into a compact configuration. For example, the spool 130 can have a smaller profile than the screen 120 in a compact configuration, as shown in FIG. 7A.

Figure 9:
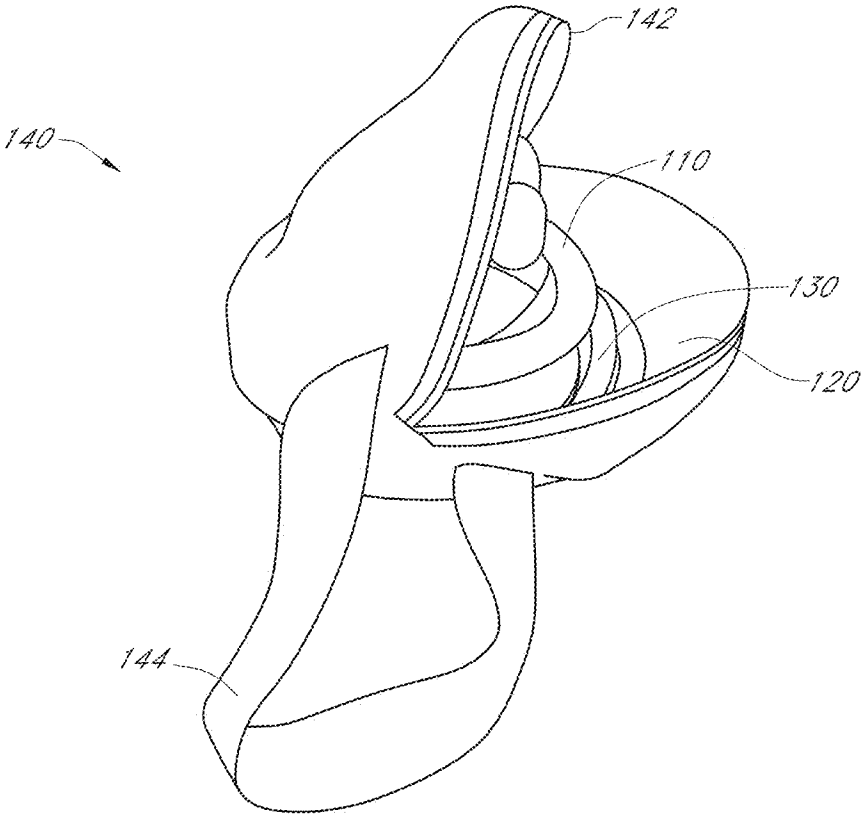
FIG. 9 illustrates the portable sunshade stored within an example bag or case.
Figure 10B:
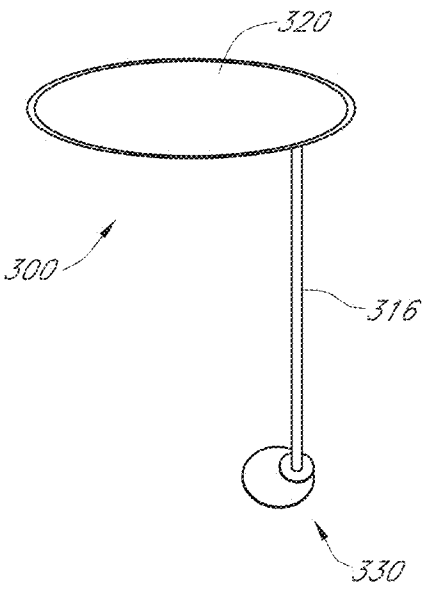
FIG. 10A-B illustrates another embodiment of a portable sunshade including an example dowel.
Figure 10A:
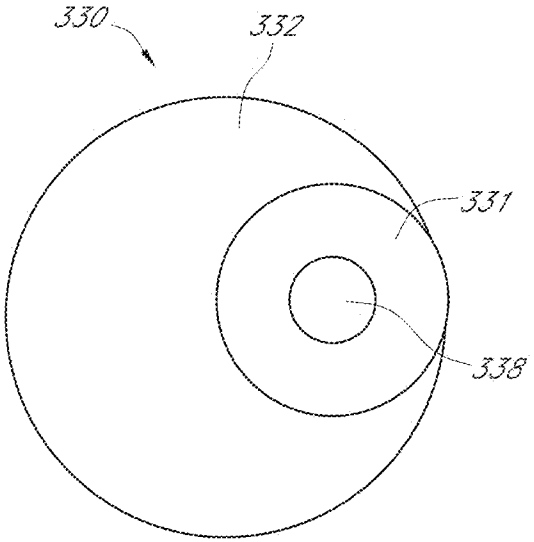

With reference to FIG. 9-10, the portable sunshade 100 can be a part of a sunshade kit 102. The kit 102 can include the support rod 110, the screen 120, a spool 130 and a case 140. The case 140 can include a carry handle 144. The case 140 can include a zipper 142. The screen 120 can be fit within case 140 in a compact configuration along with the spool 130, and the support rod 110 can be coiled to fit within the case 140. The case 140 can have a circular profile, although this is not required.

FIGS. 11A and 11B illustrate another example portable sunshade 300. The sunshade 300 can include a screen 320 having two spools 330 (one attached with the screen 320 and one attached with a support object). A support dowel or post 330 can be received within a dowel receptacle 338 in both of the spools 330. The dowel 310 can be a fixed, rigid material such as wood, metal, plastic, or any suitable material.

Terminology

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A portable sunshade kit comprising:

an expandable screen that provides shade, the expandable screen comprising a screen material and a tension wire, the tension wire disposed within a sleeve attached to an outer edge of the screen material to provide tension to the screen material;

a support rod that supports the screen, the support rod comprising a ductile core and a rubberized coating disposed around the ductile core;

a connection spool that connects the expandable screen with the support rod, the connection spool comprising an upper disc, a lower disc, and a channel disposed between the upper and lower discs, the channel sized to at least partially receive a first end of the support rod within the channel, and the upper disc adhered to the screen material of the expandable screen;

wherein the first end of the support rod is configured to form a u-shape to engage within the channel of the connection spool;

wherein a second end of the support rod is configured to at least partially wrap around a support object to support the expandable screen in a fixed position, the rubberized coating providing a frictional engagement between the support object and the support rod;

wherein the expandable screen is configured to fold into a collapsed configuration, a diameter of the expandable screen in the collapsed configuration being approximately the same as a diameter of the upper disc of the connection spool;

wherein the expandable screen, the support rod, and the connection spool are sized to fit together within a carry case when the expandable screen is in the collapsed configuration.

2. The portable sunshade kit of claim 1, wherein the kit does not include a clamp mechanism that attaches the rubberized support rod with the support object.

3. The portable sunshade kit of claim 2, wherein the second end of the rubberized support rod is not configured to attach to a clamp mechanism.

4. The portable sunshade kit of claim 1, wherein a diameter of the expandable screen in an expanded configuration is approximately three times greater than the diameter of the upper disc of the connection spool.

5. The portable sunshade kit of claim 1, further comprising a second connection spool, the second connection spool comprising a channel sized to at least partially receive the second end of the support rod and an adhesive material that attaches the second connection spool with the support object;

wherein the second end of the rubberized support rod is configured to engage within the channel of the second connection spool to support the expandable screen in a fixed position.

6. A portable sunshade comprising:

an expandable screen, the expandable screen comprising a screen material and a wire that tensions the screen material;

a support rod, the support rod comprising a ductile core and a rubberized coating disposed around the ductile core;

a connection spool, the connection spool having a first side attached to the screen material of the expandable screen, the connection spool comprising a channel;

wherein a first end of the support rod wraps at least partially around the connection spool within the channel;

wherein a second end of the support rod is configured to wrap around a support object, the rubberized coating frictionally engaging with the support object to support the expandable screen in a fixed position.

7. The portable sunshade of claim 6, wherein the second end of the support rod does not include a clamp mechanism that attaches with the support object.

8. The portable sunshade of claim 7, wherein the second end of the support rod is not configured to attach to the clamp mechanism.

9. The portable sunshade of claim 6, wherein the expandable screen is configured to fold into a collapsed configuration, a diameter of the expandable screen in the collapsed configuration being approximately the same as a diameter of the connection spool.

10. The portable sunshade of claim 9, wherein the expandable screen, the support rod, and the connection spool are sized to fit together within a carry case when the expandable screen is in the collapsed configuration.

11. The portable sunshade of claim 6, wherein the screen material comprises TYVEC™, and wherein the wire is enclosed within a nylon sleeve attached to an outer edge of the sheet material.

12. The portable sunshade of claim 6, wherein the expandable screen has a diameter of less than approximately 12 inches in an expanded configuration and a diameter of less than approximately 4 inches in a collapsed configuration.

13. The portable sunshade of claim 6, wherein a ratio of an outermost diameter of the expandable screen to an outermost diameter of the connection spool is approximately 3:1.

14. The portable sunshade of claim 6, wherein the support rod has an overall length between 16 inches and 36 inches.

15. The portable sunshade of claim 6, wherein the connection spool is attached to the screen material at a position offset radially inwardly from the wire such that an outermost profile of the connection spool is aligned within an outermost profile of the expandable screen in a collapsed configuration.

16. The portable sunshade of claim 6, wherein the connection spool comprises an aperture that receives a first end of a dowel, the dowel configured to support the expandable sunshade.

17. The portable sunshade of claim 16, wherein a second end of the dowel is received within an aperture of a second connection spool, the second connection spool attached to the support object.

18. The portable sunshade of claim 6, wherein the connection spool comprises an upper disc and a lower disc, the upper disc corresponding to the first side of the connection spool, the channel disposed between the upper and lower discs.

19. The portable sunshade of claim 6, wherein the expandable screen is circular in shape.

20. A portable sunshade kit comprising:

an expandable screen having an outer wire loop and a screen material;

a support rod having a ductile core and a rubberized coating around the ductile core;

a connection spool having a channel sized to at least partially receive the support rod, the connection spool adhered to the screen material of the expandable screen; and a carry case sized to receive the expandable screen in a collapsed configuration, the support rod, and the connection spool.

* * * * *